US006400101B1

(12) United States Patent
Biebl et al.

(10) Patent No.: US 6,400,101 B1
(45) Date of Patent: Jun. 4, 2002

(54) CONTROL CIRCUIT FOR LED AND CORRESPONDING OPERATING METHOD

(75) Inventors: Alois Biebl, St. Johann; Franz Schellhorn, Regensburg; Guenther Hirschmann, Munich, all of (DE)

(73) Assignee: Patent-Treuhand-Gesellschaft fuer Elektrische Gluehlampen mbH, Munich (DE)

( * ) Notice: Subject to any disclaimer, the term of this patent is extended or adjusted under 35 U.S.C. 154(b) by 0 days.

(21) Appl. No.: 09/762,685

(22) PCT Filed: Apr. 1, 2000

(86) PCT No.: PCT/DE00/00989

§ 371 (c)(1),
(2), (4) Date: Feb. 12, 2001

(87) PCT Pub. No.: WO01/03474

PCT Pub. Date: Jan. 11, 2001

(30) Foreign Application Priority Data

Jun. 30, 1999 (DE) ..... 199 30 174

(51) Int. Cl.[7] ..... G05F 1/00
(52) U.S. Cl. ..... 315/291; 315/185 R; 315/224
(58) Field of Search ..... 315/200 A, 185 R, 315/185 S, 224, 291, 169.1–169.4, 241 S, 241 P, 312; 362/800, 235, 227

(56) References Cited

U.S. PATENT DOCUMENTS 5,907,569 A 5/1999 Glance et al. ..... 372/38
6,111,367 A * 8/2000 Asano et al. ..... 315/291
6,161,910 A * 12/2000 Reisenauer et al. ..... 315/224

FOREIGN PATENT DOCUMENTS

| | | |
|---|---|---|
| DE | 39 11 293 A | 10/1990 |
| DE | 40 22 498 | 1/1992 |
| DE | 197 11 885 A | 9/1998 |
| DE | 197 32 828 A | 2/1999 |
| DE | 197 48 446 A | 5/1999 |
| EP | 0 891 120 A | 6/1998 |
| EP | 0 896 899 A | 7/1998 |
| GB | 2 087 604 | 5/1982 |

OTHER PUBLICATIONS

"Driver for Supplying a Pulsating Current to Light Emitting Diodes", Research Disclosure, GB, Industrial Opportunities Ltd. Havant, No. 378, Oct. 1, 1995, p. 651 XP000549126.

* cited by examiner

*Primary Examiner*—Don Wong
*Assistant Examiner*—Wilson Lee
(74) *Attorney, Agent, or Firm*—Carlo S. Bessone

(57) ABSTRACT

The drive circuit is suitable for an LED array, comprising a number of clusters of LEDs, with one cluster comprising a number of LEDs which are arranged in series and are connected to a supply voltage ($U_{Batt}$). A semiconductor switch (transistor T) is arranged in series between the LED and the supply voltage and allows the LED current to be supplied in a pulsed manner. A measurement resistor ($R_{shunt}$) for measuring the LED current is arranged in series between the LED and ground, with a control loop controlling the semiconductor switch such that a constant mean value of the LED current is achieved.

18 Claims, 7 Drawing Sheets

CONTROL CIRCUIT FOR LED AND CORRESPONDING OPERATING METHOD

The invention is based on a drive circuit for LEDs and an associated operating method as claimed in the preamble of claim 1. This relates in particular to reducing the drive power losses in light-emitting diodes (LEDs) by means of a pulsed LED drive circuit.

As a rule, series resistors are used for current limiting when driving light-emitting diodes (LEDs), see, for example, U.S. Pat. No. 5,907,569. A typical voltage drop across light-emitting diodes ($U_F$) is a few volts (for example, for Power TOPLED $U_F$=2.1 V). The known resistor $R_v$ in series with the LED (see FIG. 1) produces a particularly high power loss, particularly if the battery voltage $U_{Batt}$ is subject to major voltage fluctuations (as is normal in motor vehicles). The voltage drop across the LEDs still remains constant even when such voltage fluctuations occur, that is to say the residual voltage across the series resistor $R_v$ falls. $R_v$ is thus alternately loaded to a greater or lesser extent. In practice, a number of LEDs are generally connected in series (in a cluster) in order to achieve better drive efficiency (FIG. 2). Depending on the vehicle power supply system (12 V or 42 V), a large number of LEDs can accordingly be combined to form a cluster. With a 12 V vehicle power supply system, there is a lower limit on the battery voltage $U_{Batt}$ down to which legally specified safety devices (for example the hazard warning system) must be functional. This is 9 volts. This means that, in this case, up to four Power TOPLEDs can be combined to form a cluster (4×2.1 V=8.4 V).

The power loss in the series resistor is converted into heat, which leads to additional heating—in addition to the natural heating from the LEDs in the cluster.

The technical problem is to eliminate the additional heating (drive power loss from the series resistors). There are a number of reasons for this. Firstly, enormous losses occur in the series resistor; in relatively large LED arrays, this can lead to a power loss of several watts. Secondly, this heating from series resistors itself restricts the operating range of the LEDs. If the ambient temperature $T_A$ is high, the maximum forward current $I_F$=f ($T_A$) must be reduced in order to protect the LEDs against destruction. This means that the maximum forward current $I_F$ must not be kept constant over the entire ambient temperature range from 0 to 100° C. In addition, when LEDs with series resistors are being operated, another problem is the fluctuating supply voltage, as is frequently the case in motor vehicles (fluctuation from 8 to 16 V with a 12 V power supply system; fluctuation from 30 to 60 V with the future 42 V vehicle power supply system). Fluctuating supply voltages lead to fluctuating forward currents $I_F$, which then result in different light intensities and, associated with this, fluctuations in the brightness of the LEDs.

In the past, series resistors have always been used to limit the forward current through the LEDs. In most cases, the same board has been used for all the series resistors and, if possible, this has been mounted at a suitable distance from the LEDs. This distance was chosen so that the heating from the series resistors $R_v$ did not influence the temperature of the LEDs.

A further problem is the choice of the maximum forward current $I_F$ of LEDs. When operating LEDs with series resistors $R_v$, the maximum permissible forward current $I_F$ cannot be chosen, since the forward current must be reduced if the ambient temperature $T_A$ is higher. A forward current $I_F$ is therefore chosen which is less than the maximum permissible current (FIG. 3). This admittedly increases the temperature range for operation of the LEDs, but does not utilize the forward current $I_F$ optimally. The example in FIG. 3 (Power TOPLED, Type LA E675 from Siemens) shows the forward current $I_F$ as a function of the ambient temperature $T_A$. The maximum forward current $I_F$ may in this case be 70 mA up to an ambient temperature of 70° C. Above an ambient temperature of 70° C., the forward current $I_F$ must then be reduced linearly, until it is only 25 mA at the maximum permissible ambient temperature of 100° C. A variable series resistor $R_v$ would have to be used for optimum utilization of this method of operation of LEDs.

A further problem is voltage fluctuations. Until now, there have been no drive circuits for LEDs in practical use in order to prevent voltage fluctuations, and thus forward-current fluctuations (brightness fluctuations). They therefore have had to be tolerated by necessity.

The object of the present invention is to provide a drive circuit for an LED as claimed in the preamble of claim 1, which produces as little emitted heat and power loss as possible.

This object is achieved by the distinguishing features of claim 1. Particularly advantageous refinements can be found in the dependent claims.

A pulsed LED drive is used in order to eliminate the series resistor $R_v$ and thus the high drive power loss. FIG. 4*a* shows the principle of pulsed current regulation for LEDs. A semiconductor switch, for example a current-limiting power switch or, preferably, a transistor T (in particular of the pnp type, although the npn type is also suitable if a charging pump is also used for the drive), is connected by its emitter to the supply voltage ($U_{Batt}$) (in particular the battery voltage in a motor vehicle) . When the transistor T is switched on, a current $i_{LED}$ flows through the LED cluster (which, by way of example, in this case comprises four LEDs), to be precise until the transistor T is switched off again by a comparator. The output of the comparator is connected to the base of the transistor. The one (positive) input of the comparator is connected to a regulation voltage, and the second (negative) input of the comparator is connected to a frequency generator (preferably a triangle waveform generator with a pulse duration $T_p$ and, accordingly, a frequency $1/T_p$, since this has particularly good electromagnetic compatibility, although other pulse waveforms such as a sawtooth are also possible). The transistor T is switched on if the instantaneous amplitude of the triangle waveform voltage $U_D$ at the comparator is greater than the regulation voltage $U_{Reg}$. The current which flows is $i_{LED}$. When the instantaneous amplitude of the triangle waveform voltage falls below the constant value of the regulation voltage $U_{Reg}$ on the comparator, the transistor T is switched off again. This cycle is repeated regularly at the frequency f at which the triangle waveform generator operates.

The current flowing via the LEDs is pulsed in this way (FIG. 4*b*). The square-wave pulses have a pulse width which corresponds to a fraction of $T_p$. The interval between the rising edges of two pulses corresponds to $T_p$.

The LEDs are connected in series with a means for measuring the current (in particular a measurement resistor $R_{Shunt}$ between the LEDs and ground (case 1) or else between the semiconductor switch (transistor T) and the terminal of the supply voltage $U_{Batt}$ (case 2)). The pulsed current $i_{LED}$ is tapped off on the measurement resistor $R_{Shunt}$. The mean value of the current $\bar{i}_{LED}$ is then formed via an auxiliary means. The auxiliary means is, for example, an integration means (in case 1), preferably an RC low-pass filter, or a differential amplifier (in case 2). This mean value is used as the actual value for current regulation, and is provided as an input value to a regulator (for example a PI or PID regulator). A nominal value, in the form of a reference voltage ($U_{Ref}$) for current regulation is likewise provided as a second input value to the regulator. The regulation voltage $U_{Reg}$ at the output of the regulator is set by the regulator such that the actual value always corresponds as well as possible to the nominal value (in terms of voltage). If the supply voltage $U_{Batt}$ varies due to fluctuations, the on-time of the transistor T and the length of the square-wave pulse (FIG. 4*b*) are also adapted as appropriate. This technique is known per se as PWM (pulse-wave modulation).

The advantage of pulsed current regulation for LED clusters is primarily the rapid compensation for supply fluctuations in $U_{Batt}$ by means of PWM. The mean value of the LED current ($\bar{i}_{LED}$) thus remains constant. There are thus no longer any brightness variations in the LEDs when voltage fluctuations occur. A further advantage is protection against destruction resulting from an increased temperature, as explained above (as a function of the ambient temperature $T_A$).

The circuit according to the invention advantageously allows detailed monitoring of the operating states of the individual LED clusters. This allows simple fault identification (check for short-circuit, interruption) by sequential sampling (so-called LED scanning) of the individual LED cluster.

In addition, the large series resistor $R_v$ which has been required until now to set the current for the LED cluster is avoided. A 12 V car battery may be mentioned as an example, to which an LED cluster is connected having four LEDs of the Power TOPLED type (U=2.1 V typical) . With conventional current adjustment, this would result in a power loss in the current adjustment resistor $R_v$ of about 250 mW. In contrast, the arrangement according to the invention results in a power loss in the shunt resistor $R_{Shunt}$ of only about 5 mW (when PWM is used for current adjustment), that is to say a reduction in the power loss by a factor of 50.

A further advantage is simple current limiting in an LED cluster using a current-limiting semiconductor switch (preferably a transistor). A current-limiting power switch may also be used as the switch, which automatically ensures that the pulsed forward current $I_F$ does not exceed a maximum limit value, for example a limit value of 1 A.

The circuit arrangement according to the invention is suitable for various requirements, for example for a 12 V or else 42 V motor vehicle power supply system.

FIG. 5 shows, as a snapshot, an oscilloscope display of the pulsed current profile of the LED drive circuit for a 12 V vehicle power supply system. This shows the peak current $i_{LED}$ through the LEDs (FIG. 5*a*), which is pulsed and reaches about 229 mA. The pulse width is about 30 $\mu$s, and the subsequent dead time 70 $\mu$s. This results in a mean current $\bar{i}_{LED}$ of 70 mA.

Furthermore, FIG. 5*b* shows the associated clock frequency at the triangle waveform generator, whose frequency is about 9.5 kHz (corresponding to a pulse width of about 100 $\mu$s) . The regulation voltage $U_{Reg}$ is shown as a straight line (FIG. 5*c*), and has a value of 3.2 V.

The large series resistor $R_v$ which has been required until now for current adjustment is thus avoided and is replaced by a small measurement resistor, in the order of magnitude of $R_{Shunt}$=1Ω.

Fluctuations in the supply voltage $U_{Batt}$ are now compensated for, and the forward current $I_F$ can easily be kept constant. This is because, when the value of the supply voltage changes, the regulation voltage $U_{Reg}$ likewise changes, and thus the on-time of the transistor. This pulse-width modulation, in which an increase in the supply voltage results in the transistor on-time being shortened (the same applies in the converse situation) automatically always results in a constant current, which is set on the regulator in the form of a reference voltage $U_{Ref}$ (see FIG. 4*a*) Thus, since the forward current $I_F$ in the LED cluster is constant, it is also impossible for there to be any more brightness fluctuations when the supply voltages vary.

The circuit arrangement according to the invention allows the temperature to be regulated. According to FIG. 3 (using the example of Power TOPLEDs), the maximum forward current $I_F$ of 70 mA in this case must not be kept constant over the entire permissible temperature range (up to an ambient temperature of $T_A$=100° C.) . Above an ambient temperature of $T_A$=70° C., the forward current $I_F$ must be reduced and, at $T_A$=100° C., it must finally be switched off. In order to achieve temperature regulation, a temperature sensor (preferably in SMD form) is also fitted in the LED array on the board, to be precise at the point which is expected to be the hottest. If the temperature sensor measures an ambient temperature of at least $T_A$=70° C., the forward current $I_F$ is reduced in accordance with the specification on the datasheet (FIG. 3). The forward current $I_F$ is switched off at an ambient temperature of $T_A$=100° C. This temperature regulation measure is necessary in order to protect the light-emitting diodes against thermal destruction from overheating, and in order thus not to shorten their life.

This circuit arrangement allows malfunctions in the LED cluster to be identified easily. If an LED cluster in an LED array (comprising a number of LED clusters) fails, it may be important to signal this failure immediately to a maintenance center. This is particularly important in the case of safety facilities, for example in the case of traffic light systems. Even in the motor vehicle area (passenger vehicles, goods vehicles), it is desirable to be informed about the present status of the LEDs, for example if the tail lights are equipped with LEDs.

The best known fault types are an interruption and a short-circuit. The short-circuit fault type can be virtually precluded with LEDs. If LEDs fail, then, generally, this is due to an interruption in the supply line. An interruption in LED is predominantly due to the influence of heat. This is caused by expansion of the resin (epoxy resin as part of the housing) under the influence of heat, so that the bonding wire which is embedded in it and expands to a different extent (connecting line between the LED chip and the outer pin) breaks.

Another possible destruction mechanism is likewise caused by the influence of heat. Excessive heat softens the resin (that is to say the material of which the housing is composed) which becomes viscous. The chip can become detached, and starts to move. In consequence, the bonding wire can likewise tear.

Thus, in general, mechanical defects (such as tearing of the bonding wire) can be expected as a result of the influence of the severe heating. A circuit for interruption identification in an LED cluster makes it possible to signal the occurrence of a fault to an output (for example a status pin in the case of a semiconductor module). Logic 1 (high) means, for example, that a fault has occurred, while logic 0 (low) indicates the serviceable state.

The drive circuit according to the invention may be produced in the form of a compact LED drive module (IC) which is distinguished by the capability to stabilize the forward current ($I_F$=const.) in LEDs. Further advantages are the external, and thus flexible, forward current adjustment, the low power loss due to switched operation (no need for the large series resistor $R_v$), the interruption identification in the LED cluster, and the temperature regulation for protection of the LEDs. Another factor is the low amount of current drawn by the LED drive circuit itself (economic standby operation).

In the standby mode, the LED drive module remains connected to a continuous positive (battery voltage in a motor vehicle), although it is switched off, that is to say no current flows through the LEDs. In this state, the drive module itself draws only a small amount of current (intrinsic current consumption tends to 0), in order to avoid loading the battery in the motor vehicle. This is the situation when, for example, the car is parked in a garage or in the open air. Additional current consumption would in this case unnecessarily load the battery. The LED drive module is switched on and off via a logic input (ENABLE input).

In addition, the circuit arrangement can be designed to be resistant to polarity reversal and to provide protection against overvoltages. A polarity reversal protection diode ensures that the LED drive module is not destroyed if it is connected with the wrong polarity to the supply voltage (battery). A combination of a zener diode and a normal diode provides additional protection for the LED drive module against destruction due to overvoltages on the supply voltage pin $U_{Batt}$.

In one particularly preferred embodiment, a microcontroller-compatible ENABLE input (logic input) is also provided, which allows a microcontroller to be used for drive purposes. The drive module (in particular an integrated circuit IC) for LEDs can thus be integrated in a bus system (for example the CAN bus in a motor vehicle, and the Insta bus for domestic installations).

The invention will be explained in more detail in the following text with reference to a number of exemplary embodiments. In the figures.

FIGS. 1 to 5 have already been described above.

Figure 1:
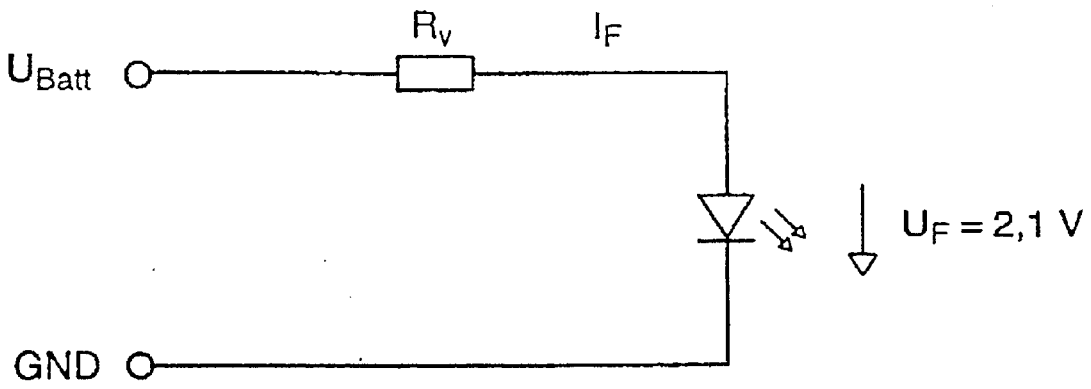
Fig. 1 (Prior Art)
FIG. 1 shows a known drive for LEDs
Figure 2:
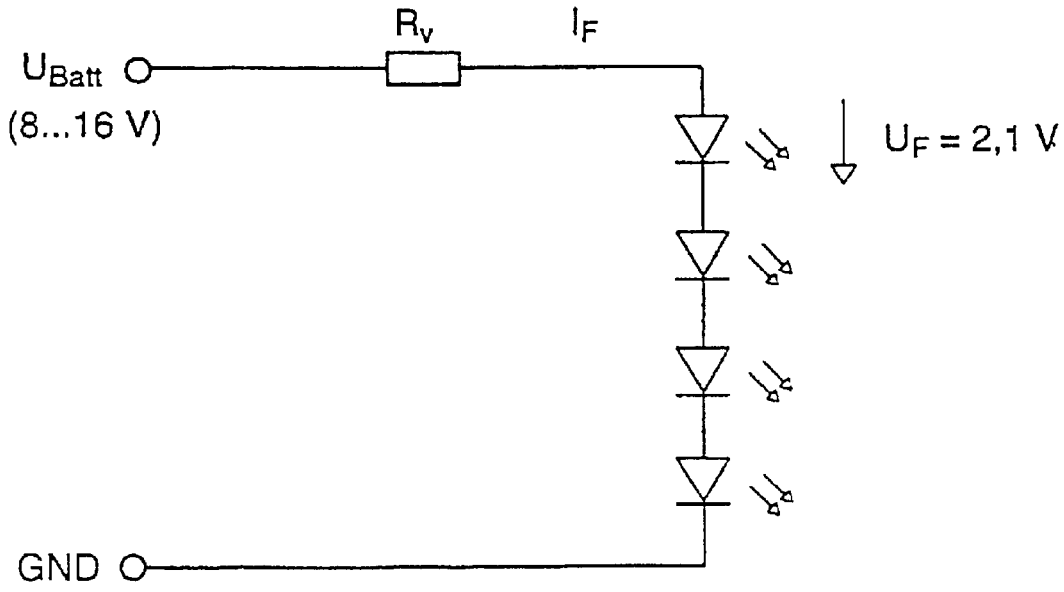
Fig. 2 (Prior Art)
FIG. 2 shows a further exemplary embodiment of a known drive for LEDs
Figure 3:
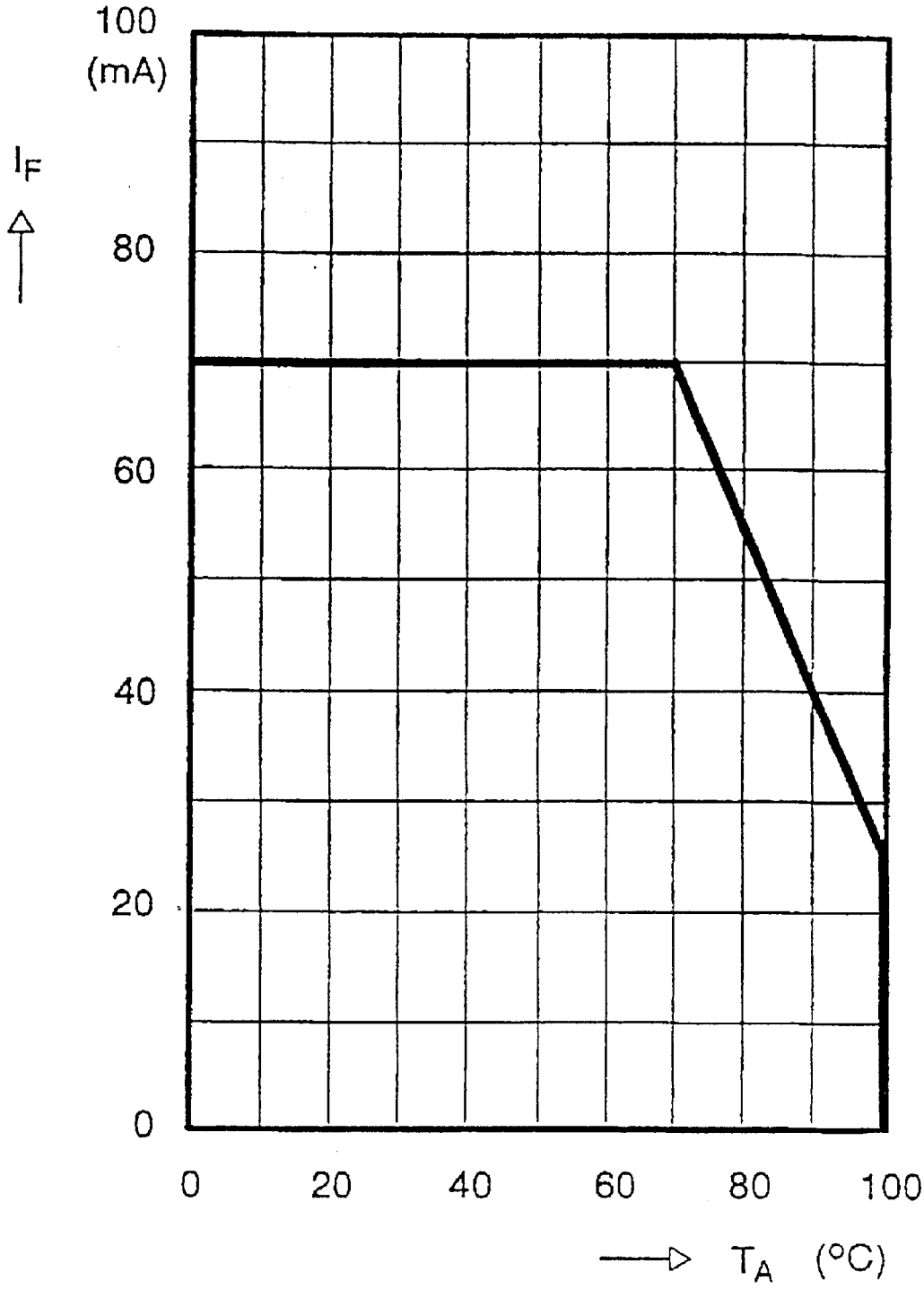
FIG. 3 shows the relationship between the forward current of an LED and the ambient temperature
Figure 4B:
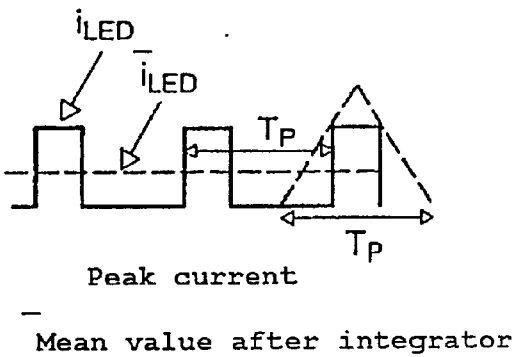
FIG. 4 shows the basic principle of pulsed current regulation for an LED (FIG. 4*a*) and an explanation of the peak current and mean value (FIG. 4*b*)
Figure 4A:
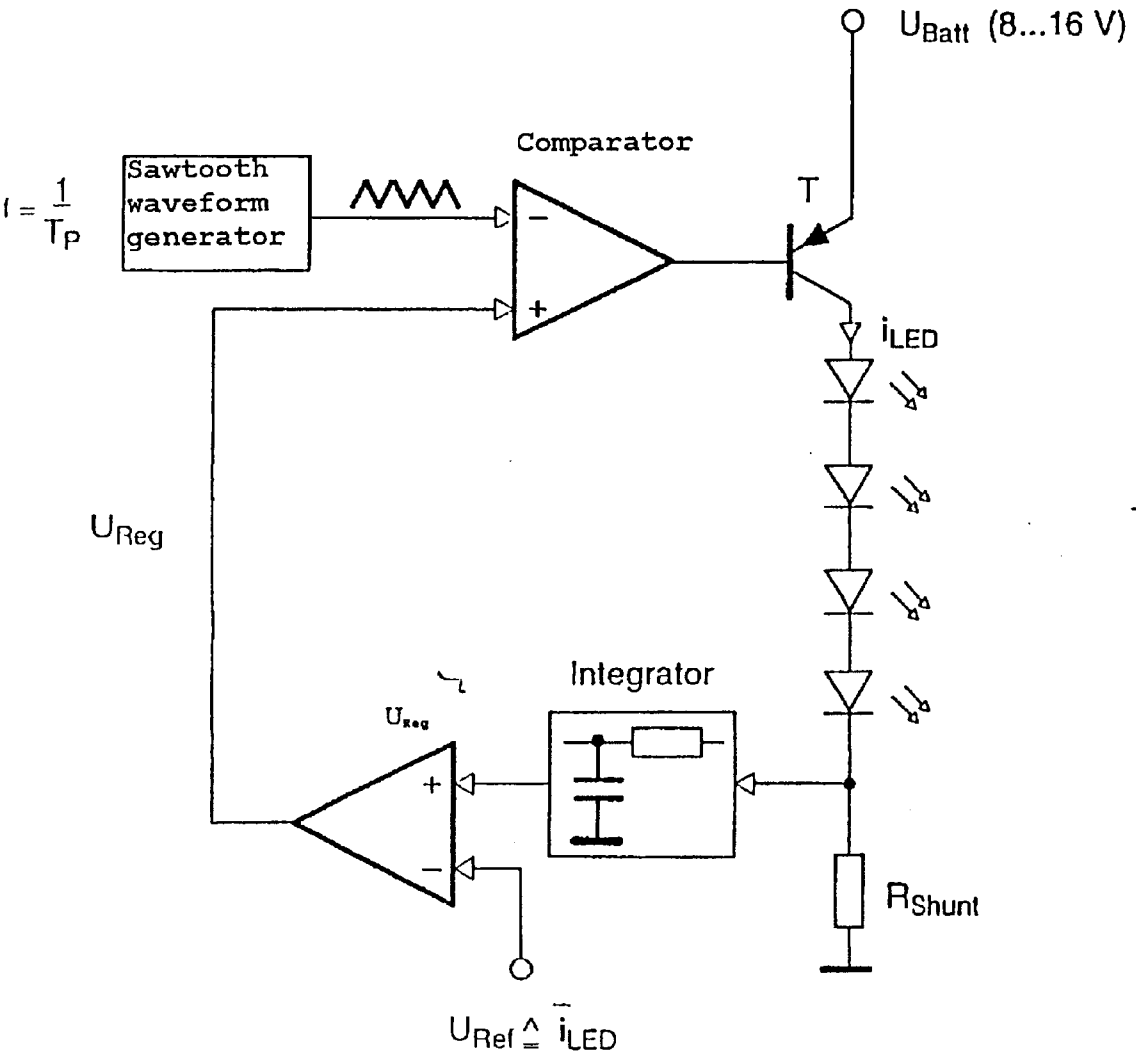
Figure 5:
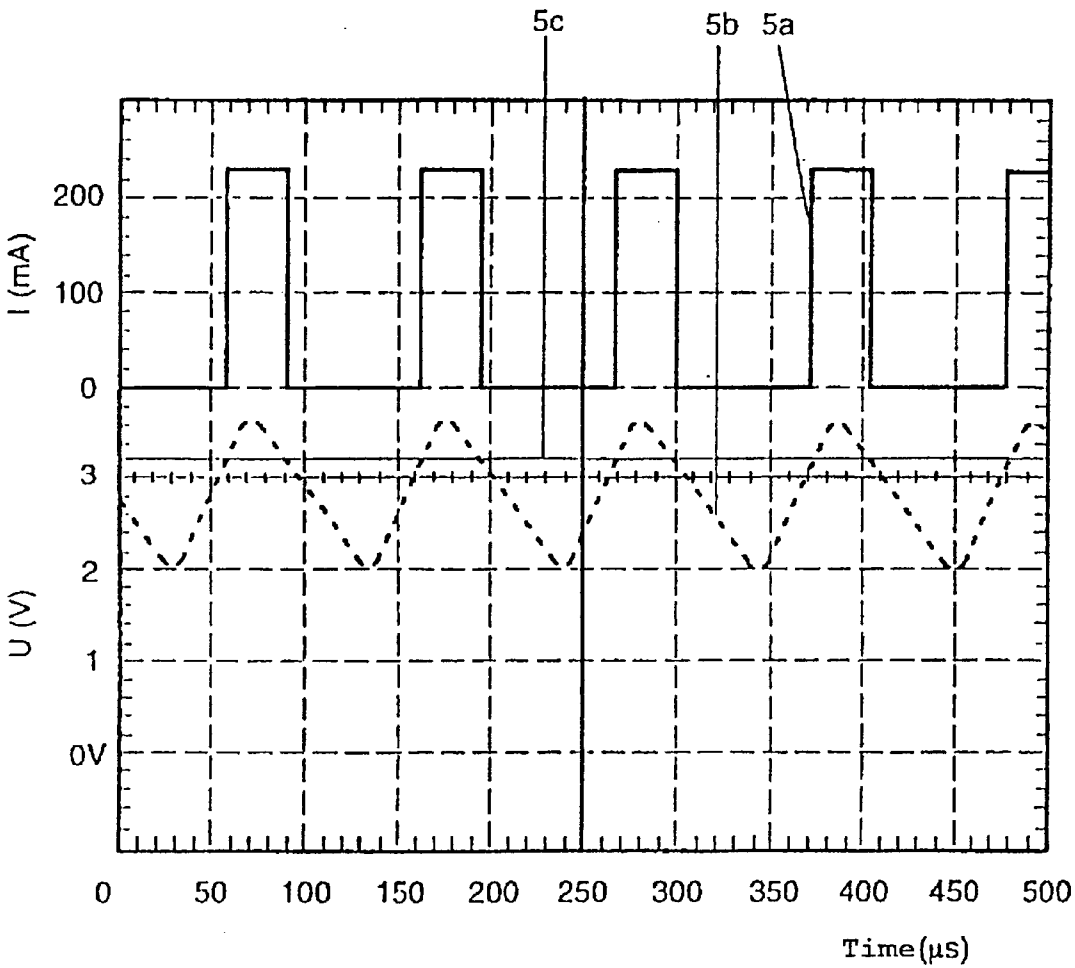
FIG. 5 shows the current profile of pulsed current regulation for an LED
Figure 6:
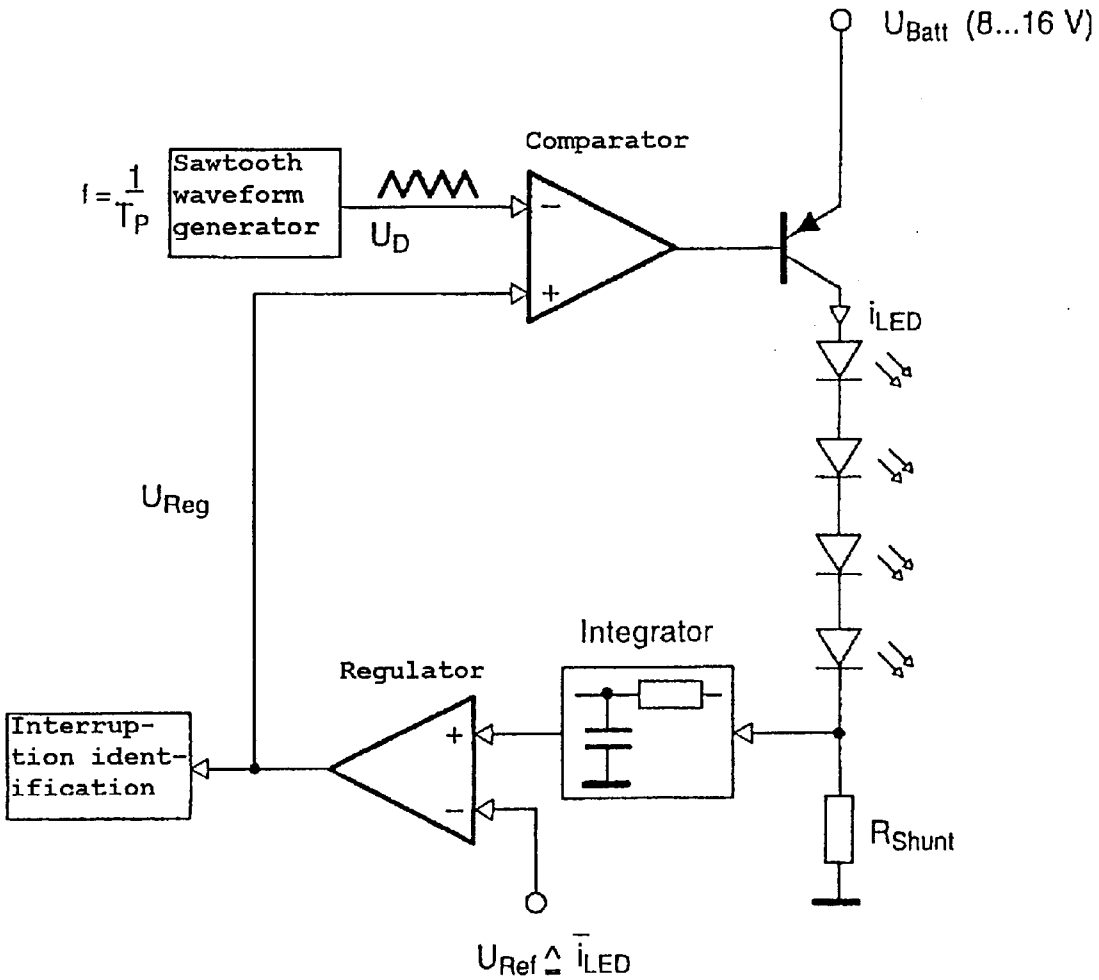
FIG. 6 shows pulsed current regulation with interrupter identification

An exemplary embodiment (entire block diagram) of the implementation of interruption identification is shown in FIG. 6. An interruption in the LED cluster can be detected by direct monitoring of the regulation voltage $U_{Reg}$ by means of an interruption identification device (in this context, see the detail in FIG. 7). If an interruption occurs, the regulation voltage is zero ($U_{Reg}$=0). This fault situation can be indicated at an output (status pin) via an evaluation circuit A (FIG. 8).

It is advantageous for this output to be in the form of an open collector circuit (FIG. 8), since the circuit user, who will be using the LED drive module (IC) later, is then independent of the output signal level. The status output circuit has a transistor as the output stage, whose collector is open (that is to say it has no pull-up resistor). The collector of the transistor leads directly to the status pin of the LED drive module (FIG. 8). If an external pull-up resistor $R_p$ is connected to the collector of the transistor $T_{oc}$, it can be connected to any desired voltage $V_{cc}$. The output signal level accordingly depends on the voltage $V_{cc}$ to which the pull-up resistor $R_p$ is connected.

Figure 7:
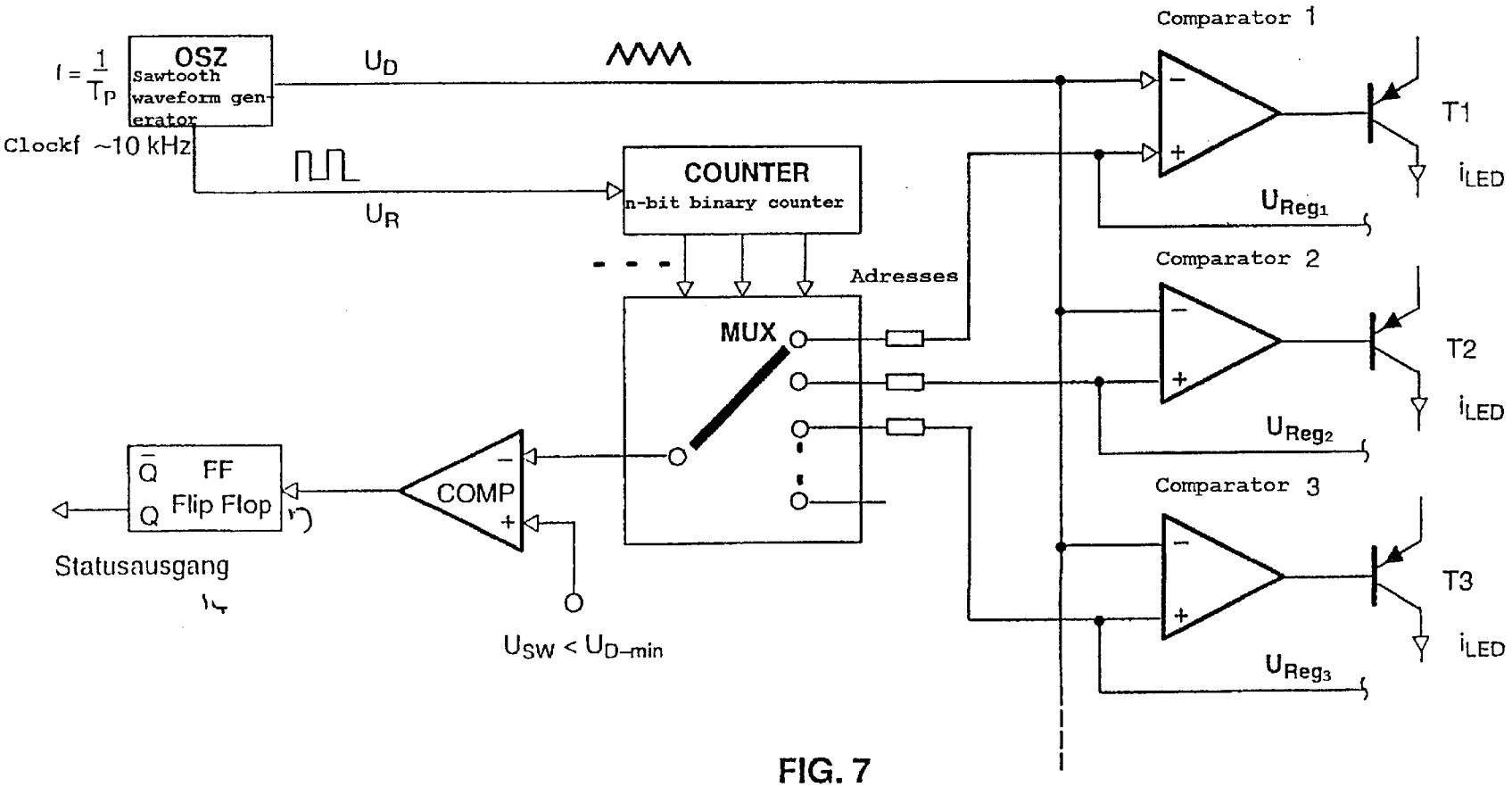
FIG. 7 shows the implementation of interrupter identification for an LED cluster
Figure 8:
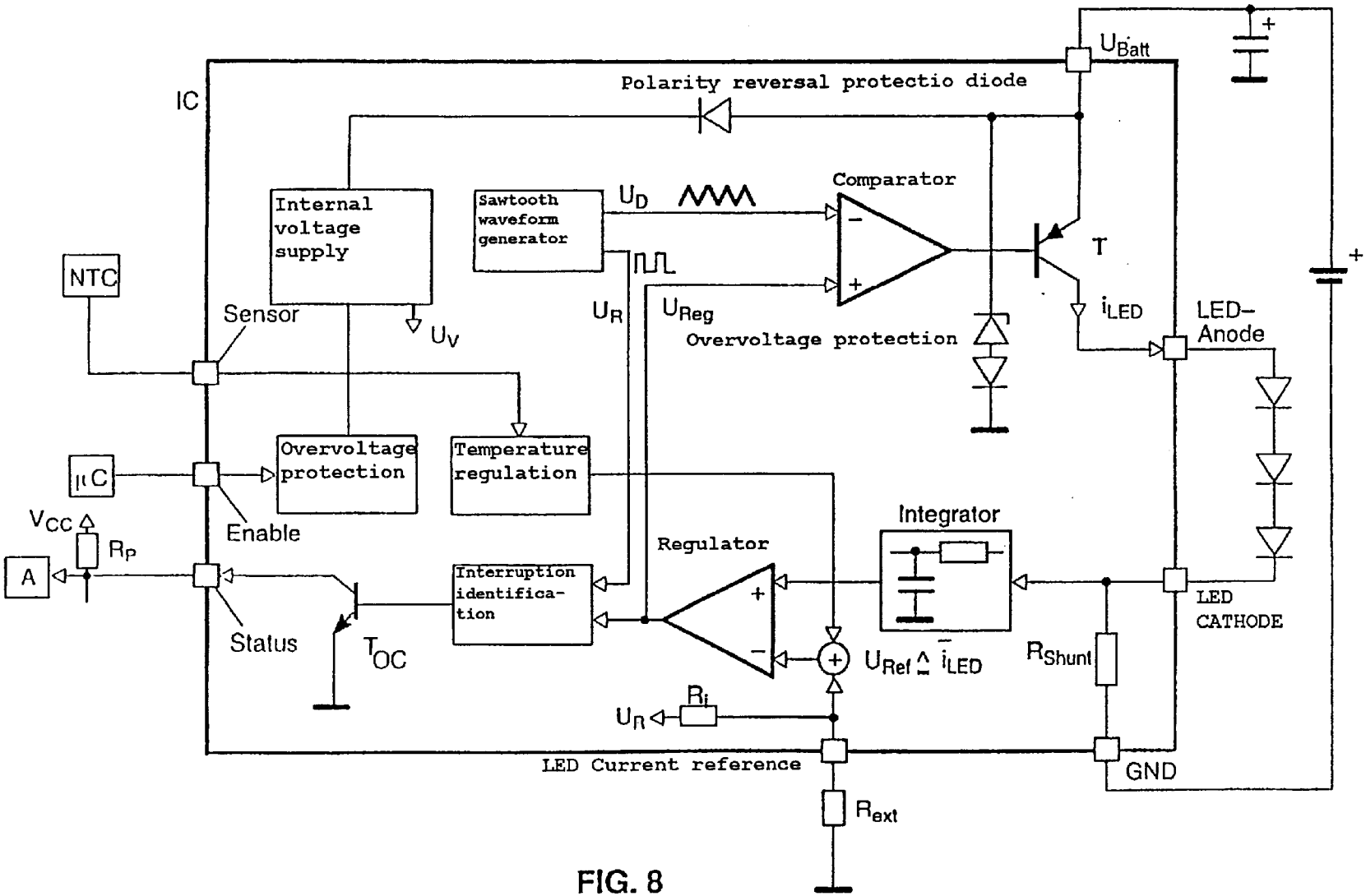
FIG. 8 shows a block diagram of an LED drive circuit.

FIG. 7 shows the technical implementation of an interruption identification device in the LED cluster. The interruption identification device in the LED cluster operates on the principle of sampling (scanning) a voltage (in this case, regulation voltage $U_{Reg}$) . The regulation voltage $U_{Reg}$ has a minimum value which is as great as the minimum voltage $U_{D_min}$ from the triangle waveform generator. As can be seen from FIG. 5, this voltage level is about 2 V. This assumes that the regulation is active and that there is no interruption in the LED cluster. If there is an interruption in the LED cluster, the regulation voltage value is 0 Volts ($U_{Reg}$=0 V).

FIG. 7 shows the complete block diagram of the interruption identification device in the LED cluster based on the principle of sampling or scanning a voltage. The clock (as a square-wave voltage $U_R$) is passed to an n-bit binary counter (COUNTER) from the internal oscillator (OSZ) which runs at a specific frequency (in this case: approx. 9.5 kHz). The binary counter must be designed to match the number of LED clusters (and, accordingly, the number of regulation voltages $R_{Reg}$) which are intended to be sampled or scanned. A 3-bit binary counter (for addresses from 0 to 7) is used by way of example. This thus allows up to 8 regulation voltages $U_{Reg}$ to be sampled or scanned.

The 3-bit binary pattern of the counter controls an analog multiplexer (MUX) which (depending on the applied binary word) samples or scans all the regulation voltages $U_{Reg1,2\ldots}$ successively, and produces them in sequence at the output. The lowest regulation voltage $U_{Reg_min}$ (regulation active and no interruption in the LED cluster) corresponds to the minimum value of the triangle waveform voltage $U_{D_min}$.

In order to successfully detect a low signal of the regulation voltage $U_{Reg}$ (corresponding to 0 Volts, interruption in the LED cluster) and to provide this for subsequent storage in a memory medium, for example a flipflop (FF), a comparator (COMP) is introduced at the output of the analog multiplexer (MUX). The switching threshold $U_{SW}$ of this comparator (COMP) must be less than the minimum value of the triangle waveform voltage $U_D$, that is to say $U_{SW}<U_{D_min}$.

If a low signal is now detected in the sampled regulation voltage $U_{Reg}$, a high signal is set at the comparator output. This high signal is then stored in the flipflop (FF) until the fault (interruption in the LED cluster) has been rectified once again.

The status output (status=output of FF) has the following meaning:

High signal=interruption in an LED cluster

Low signal=no interruption

The flipflop FF, and thus the status output, is reset only once the LED drive module has been switched off, that is to say when fault rectification is being carried out in the LED cluster.

The status output can be reset in 2 ways:

Switch off the LED drive module (IC) via the ENABLE input. The LED drive module (IC) is integrated in a system together with a microcontroller ($\mu$C) via this output (FIG. 8). In the motor vehicle area, the drive may, for example, make use of a CAN bus.

Disconnect the supply voltage from the LED drive module (IC). If the ENABLE input is not required, it must be connected to the battery voltage. This method can be used in simple systems, without any microcontroller drive.

FIG. 8 (block diagram of the LED drive module) also illustrates the circuit arrangement for protection against polarity reversal and overvoltage protection. A polarity reversal protection diode between the external ($U_{Batt}$) and internal voltage supply ensures that the LED drive module is not destroyed if it is connected with the wrong polarity to the supply voltage (battery). The overvoltage protection is provided by a zener diode in combination with a diode with the reverse polarity.

The IC also contains a connecting pin for a temperature sensor (for example an NTC) and a pin for connection of current reference, as well as two pins for connection of the LED cluster.

External, and thus flexible adjustment (programming) of the forward current $I_F$ of an LED cluster is achieved in that, firstly, an internal pull-up resistor $R_i$ is connected to the internal voltage supply $U_V$ of the IC and to an input for an LED current reference, so that an external resistor $R_{ext}$, connected to ground, forms a voltage divider with the internal pull-up resistor $R_i$, and thus sets the desired forward current level $I_F$, and in that, secondly, the DC voltage, which can be adjusted up to the maximum forward current level $I_F$, is provided at the input for the LED current reference, and is used as a measure of the forward current level $I_F$.

A logic drive for the module (IC) is provided by a logic signal level (low or high) switching the module off or on via an input (ENABLE).

Fault signaling via a STATUS output is provided by this output having an open collector (for bipolar integration) or else an open drain (for CMOS integration), and connection of an external pull-up resistor $R_p$ allows the output signal level for the fault signal level (high signal) to be freely defined.

What is claimed is:

1. A drive circuit for LEDs comprising one or more clusters of LEDs with one cluster comprising a number of LEDs which are arranged in series and are connected to a supply voltage ($U_{Batt}$), characterized in that a semiconductor switch (T) is arranged in series between the LED cluster and the supply voltage, which semiconductor switch (T) allows an LED current to be supplied in pulsed manner, and in that a means for measuring a forward current $I_F$ including a measurement resistor ($R_{Shunt}$), is arranged in series with the LEDs in the path for the forward current $I_F$, between the LEDs and a ground, with a control loop controlling the semiconductor switch (T) such that a constant mean value of the LED current is achieved, the control loop includes an integration element, a comparator or a regulator.

2. The drive circuit as claimed in claim 1, characterized in that the semiconductor switch is a transistor (T).

3. The drive circuit as claimed in claim 1, characterized in that the control loop has a comparator which compares a signal from a frequency generator with a regulation voltage ($U_{Reg}$).

4. The drive circuit as claimed in claim 1, characterized in that the control loop has a regulator which compares an actual value of a mean value of the LED current with a nominal value.

5. The drive circuit as claimed in claim 3, characterized in that the regulation voltage ($U_{Reg}$) is monitored by a means for interruption identification.

6. The drive circuit as claimed in claim 5, characterized in that a number of LED clusters are monitored by a frequency generator (OSZ) passing a clock to a binary counter which controls an analog multiplexer (MUX) which samples regulation voltages ($U_{Reg1,2 \ldots}$) of all the LED clusters.

7. The drive circuit as claimed in claim 6, characterized in that an output signal from the multiplexer is passed via a comparator (COMP) to a memory medium (FF).

8. The drive circuit as claimed in claims 1, characterized in that said drive circuit is in the form of an integrated module (IC).

9. The module as claimed in claim 8, characterized in that external, and thus flexible, adjustment (programming) of the forward current $I_F$ in an LED cluster is provided in that, firstly, an internal pull-up resistor $R_i$ is connected to an internal voltage supply ($U_v$) of the module (IC) and to one input of an LED current reference, such that an external resistor ($R_{ext}$) connected to ground forms a voltage divider together with the internal pull-up resistor ($R_i$) and thus sets the desired forward current $I_F$, and such that, secondly, a DC voltage which can be adjusted as far as a maximum forward current $I_F$ is provided at the input for the LED current reference and is used as a measure of the forward current $I_F$.

10. The module as claimed in claim 8, characterized in that a logic drive for the module (IC) is provided in that a logic signal level (low or high) for the module is switched off or on via an input (ENABLE).

11. The module as claimed in claim 8, characterized in that fault signaling is provided via a STATUS output which has an open collector or an open drain, and the output signal level for a fault signal level can be defined by connection of an external pull-up resistor $R_p$.

12. The module as claimed in claim 8, characterized in that protection against polarity reversal when the module (IC) is connected to a supply voltage is provided by a polarity reversal protection diode which protects internal circuits of the module.

13. The module as claimed in claim 8, characterized in that protection against any overvoltages which occur at an input for the supply voltage is provided by a combination of a zener diode and a diode in an opposite polarity which acts at an input pin for the supply voltage ($U_{Batt}$).

14. A method for operation of an LED characterized in that an LED forward current $I_F$ is pulsed by means of a fast semiconductor switch (transistor T), and characterized in that an actual value of a mean value of the LED current is compared with an external nominal value via a regulator, with regulation being carried out by pulse-width modulation.

15. The method as claimed in claim 14, characterized in that an output signal of the regulator is compared with a signal from a frequency generator (OSZ), by means of a triangle waveform generator.

16. The method as claimed in claim 14, characterized in that a control signal is monitored by a means for interruption identification by means of a flipflop (FF), or by means of LED scanning.

17. The method as claimed in claim 14, characterized in that temperature-dependent control of the forward current of the LEDs is provided by means of a temperature-sensing element connected via a sensor input, and the forward current $I_F$ is regulated back in accordance with a predetermined characteristic when an ambient temperature $T_A$ exceeds a specific threshold value.

18. The method as claimed in claim 14, characterized in that the circuit is operated with different supply voltages, wherein an internal voltage supply produces a stable internal supply voltage from each input voltage ($U_{Batt}$).

* * * * *